US008485728B2

(12) United States Patent
Bowers et al.

(10) Patent No.: US 8,485,728 B2
(45) Date of Patent: Jul. 16, 2013

(54) RESEALABLE PACKAGING

(75) Inventors: Paul K. Bowers, Long Valley, NJ (US); James A. Glydon, Cedar Knolls, NJ (US); Allen Aldridge, South Orange, NJ (US)

(73) Assignee: Kraft Foods Global, Inc., Northfield, IL (US)

( * ) Notice: Subject to any disclaimer, the term of this patent is extended or adjusted under 35 U.S.C. 154(b) by 1033 days.

(21) Appl. No.: 12/002,390

(22) Filed: Dec. 17, 2007

(65) Prior Publication Data

US 2008/0170814 A1 Jul. 17, 2008

Related U.S. Application Data

(60) Provisional application No. 60/875,508, filed on Dec. 18, 2006, provisional application No. 60/957,554, filed on Aug. 23, 2007.

(51) Int. Cl.

| | |
|---|---|
| ***B65D 33/00*** | (2006.01) |
| ***B65D 30/00*** | (2006.01) |
| ***B65D 30/22*** | (2006.01) |
| ***B65D 33/24*** | (2006.01) |
| ***B65D 33/16*** | (2006.01) |
| ***A23B 7/148*** | (2006.01) |

(52) U.S. Cl.
USPC ..... 383/204; 383/37; 383/38; 383/43; 383/61.1; 426/106

(58) Field of Classification Search
USPC ..... 383/43, 61.2, 61.1, 203, 204, 95, 383/71, 35, 33, 906, 92, 93; 426/106; 222/528, 222/541.5, 541.6; 229/87.05
See application file for complete search history.

(56) References Cited

U.S. PATENT DOCUMENTS

| | | | | |
|---|---|---|---|---|
| 1,798,945 | A | 3/1931 | Lamarthe | |
| 1,973,956 | A * | 9/1934 | Hickman | 383/43 |
| 2,188,191 | A * | 1/1940 | Roos | 222/490 |
| 2,263,191 | A | 11/1941 | Saladin et al. | |
| 2,422,605 | A | 6/1947 | Wells | |
| 2,430,995 | A * | 11/1947 | Roos | 222/107 |
| 2,550,132 | A | 4/1951 | Woods | |
| 2,663,461 | A | 12/1953 | Brown | |
| 2,753,091 | A | 7/1956 | Herzig | |
| 2,815,150 | A | 12/1957 | Herzig | |
| 2,960,259 | A | 11/1960 | Aveni | |
| 3,110,335 | A | 11/1963 | Antonius | |
| 3,236,369 | A | 2/1966 | Moore | |
| 3,272,248 | A | 9/1966 | O'Farrell | |
| 3,280,870 | A | 10/1966 | Bundy | |
| 3,306,493 | A | 2/1967 | Szajna | |

(Continued)

FOREIGN PATENT DOCUMENTS

| | | | |
|---|---|---|---|
| EP | 1275590 | A2 * | 1/2003 |
| GB | 2311275 | A * | 9/1997 |
| WO | 2006127739 | | 11/2006 |
| WO | WO 2010142744 | A1 * | 12/2010 |

*Primary Examiner* — Jes F Pascua

(74) *Attorney, Agent, or Firm* — Hoffmann & Baron, LLP

(57) ABSTRACT

A package including a package body having closed ends, at least one of the closed ends being openable. A reclosable member including a band disposed on the package body, the band being adjacent to and encircling the openable closed end. The reclosable member maintains the at least one of the openable end in a closed condition after opening thereof. The openable end is selectively and repeatedly openable and reclosable upon manipulation of the package body.

23 Claims, 8 Drawing Sheets

U.S. PATENT DOCUMENTS

| | | | | | |
|---|---|---|---|---|---|
| 3,334,804 | A | * | 8/1967 | Watts, Jr | 206/463 |
| 3,342,318 | A | | 9/1967 | Ruekberg et al. | |
| 3,430,809 | A | | 3/1969 | Vanstrom | |
| 3,616,990 | A | | 11/1971 | Powell | |
| 3,768,636 | A | | 10/1973 | O'Connell, Jr. | |
| 4,762,230 | A | | 8/1988 | Croce | |
| 4,810,745 | A | | 3/1989 | Pike et al. | |
| 4,917,267 | A | * | 4/1990 | Laverdure | 222/107 |
| 4,978,030 | A | | 12/1990 | Morris et al. | |
| 5,018,621 | A | | 5/1991 | O'Connell, Jr. | |
| 5,037,138 | A | | 8/1991 | McClintock et al. | |
| 5,072,855 | A | | 12/1991 | Herzig | |
| 5,178,298 | A | | 1/1993 | Allina | |
| 5,472,281 | A | | 12/1995 | Phelps | |
| 5,529,224 | A | * | 6/1996 | Chan et al. | 222/212 |
| 5,623,980 | A | | 4/1997 | McMahon | |
| 6,029,850 | A | | 2/2000 | Pate et al. | |
| 6,391,353 | B1 | * | 5/2002 | Marbler et al. | 426/115 |
| D486,638 | S | | 2/2004 | Menceles | |
| 6,737,130 | B2 | | 5/2004 | Ferri | |
| 6,886,739 | B1 | | 5/2005 | Tsengas | |
| 7,665,895 | B2 | * | 2/2010 | Takita et al. | 383/88 |
| 2002/0088825 | A1 | * | 7/2002 | Laverdure | 222/107 |
| 2003/0077007 | A1 | | 4/2003 | Turvey et al. | |
| 2004/0031795 | A1 | | 2/2004 | Galland et al. | |
| 2004/0208402 | A1 | | 10/2004 | Yeager | |
| 2005/0025394 | A1 | | 2/2005 | Kinigakis et al. | |
| 2005/0035150 | A1 | * | 2/2005 | Laverdure | 222/92 |
| 2006/0023976 | A1 | | 2/2006 | Alvater et al. | |
| 2006/0280386 | A1 | * | 12/2006 | Bublitz | 383/33 |
| 2006/0291756 | A1 | | 12/2006 | Thomas et al. | |
| 2012/0141048 | A1 | * | 6/2012 | Ribi | 383/35 |

* cited by examiner

RESEALABLE PACKAGING

CROSS-REFERENCE TO RELATED APPLICATIONS

This application claims priority to U.S. Provisional Application Nos. 60/875,508 filed on Dec. 18, 2006 and 60/957,554 filed on Aug. 23, 2007. Both applications are incorporated by reference herein in their entireties for all purposes.

FIELD OF THE INVENTION

The present invention relates generally to packages for containing various products. More particularly, the present invention relates to a package for containing and dispensing products such as confectionery products including candy and gum, and which has a self-closing opening that can be repeatedly opened and closed.

BACKGROUND OF THE INVENTION

The art has seen a wide variety of packages for containing and dispensing products, particularly confectionery products such as candy and gum. Quite often, one or multiple pieces of candy or gum are packaged in a single package. The consumer would open the package to dispense the individual products or portions of a single product. When a consumer uses less than all of the contents contained in the package, a problem arises with respect to reclosing the package. This problem is particularly evident where small packages such as bags or wrappers are employed. Moreover, where the products are candy or gum pieces and are contained in the package in an unwrapped condition, reclosing of the package once opened becomes a significant concern.

Many of the packages containing candy and gum include sealed ends which initially contain and protect the products. However, once one of the sealed ends is opened to dispense some of the contents, it is difficult to provide an effective closure for that end. Moreover, when dispensing a plurality of products it is often necessary to repeatedly open and close the package.

It is, therefore, desirable to provide a simple, cost effective and useful technique to reclose the end of a previously sealed package in a manner which will allow repeated opening and closing of the package to dispense additional product.

SUMMARY OF THE INVENTION

The present invention provides a package for containing and dispensing product having an end which may be repeatedly opened and reclosed.

The present invention also provides a package for containing and dispensing product having a package body and a band for permitting an opened end to be repeatedly opened and closed.

The present invention further provides a package including a package body having closed ends, at least one of the closed ends being openable. A reclosable member including a continuous band disposed on the package body, the band being adjacent to and encircling the openable closed end. The reclosable member maintains the at least one of the openable end in a closed condition after opening thereof. The openable end is selectively and repeatedly openable and reclosable upon manipulation of the package body.

The present invention still further provides a package for confectionery products including a package body having closed ends, at least one of the closed ends being detachably sealed. A continuos resilient band encircling the package inwardly adjacent the detachably sealed closed end. The resilient band maintaining the one closed end in a closed condition after detachment of the detachable seal and being openable under manual squeeze pressure to open the package, and reclosable after release of the manual squeeze pressure.

The present invention still yet further provides a package for confectionery products including a package body having closed ends, at least one of the closed ends being openable. A reclosable member is provided which includes a band of pressure sensitive adhesive material disposed on an inner surface of the package body. The band is inwardly adjacent to and encircling the openable closed end. The reclosable member maintains the at least one of the openable end in a closed condition after opening thereof. The openable end is selectively and repeatedly openable and reclosable upon manipulation of the package body.

DETAILED DESCRIPTION OF THE PREFERRED EMBODIMENTS

The present invention provides a package for containing and dispensing product. In particular, the present invention may be used for containing and dispensing confectionery products such as gum pieces. While the particular embodiment shown herein is employed to contain gum pieces, it may be appreciated that the package may contain any type of product. Such product may also include other confectionery products such as gum in various sizes and shapes such as sticks, slabs, pillows, pellets and the like as well as other confectionery products such as candy, chocolate and the like. Non-confectionery products may also be employed.

Referring to FIGS. 1-4, one embodiment is shown. A package 10 is used to contain and dispense a plurality of product pieces 12 which may be in the form of gum pieces that are contained in loose orientation within the package 10. The gum pieces may be any size, shape, or configuration including slabs, pellets and sticks. While individual discrete gum pellets are shown, it is contemplated that the package may contain one or more products having portions thereof that can be broken away or detached for use. Moreover, while unwrapped gum pieces are shown, the package may contain individually wrapped gum pieces. The package 10 includes a generally elongate tubular body 11 which may be formed of a of a thin-film flexible material. Body 11 may be formed of wide variety of conventional materials such as polypropylene. The package 10 includes opposed closed ends 14 and 16 which are sealed closed. Various conventional techniques are known for sealably closing the ends 14 and 16 of package 10. These techniques may include crimp-sealing the ends, as well as heat-sealing the ends. The seals are such that they hermetically seal the package, thereby protecting the gum pieces 12 contained therein during shipping and prior to use. While one preferred embodiment is shown, it may be appreciated that any package configuration such as a bag or wrapper may be employed.

Figure 2:
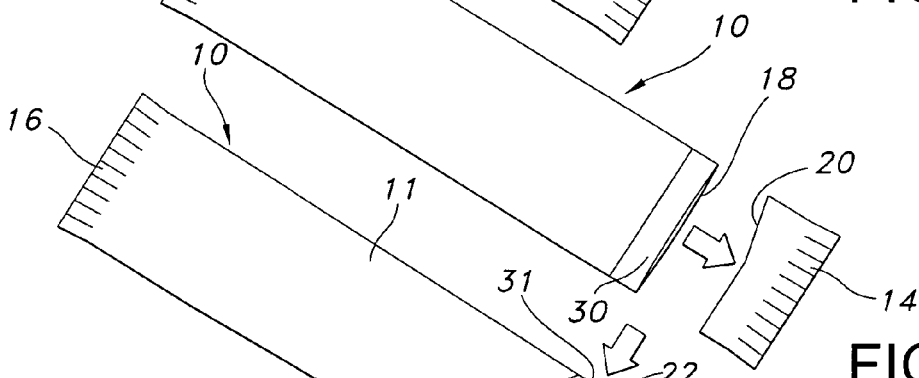
FIG. 2 shows the package of FIG. 1 including one sealed end detached therefrom.

One of the ends 14 or 16 may be detached from the package 10 to open the package to permit dispensing of the gum pieces 12 therefrom. As shown in FIG. 2, end 14 may be detached from the body 11 providing an open end 18 (FIG. 3) through which the gum pieces 12 may be dispensed. Alternatively, the end may be opened and not detached from the package. End 14 may integrally formed with the package body and removed by tearing the end 14 from the remainder of the package 10. It is also contemplated that the end 14 may include a frangible line 20 therearound which assists in tearing the end 14 from the body 11 of the package 10. The line 20 may be a score line or a laser cut line which assists in removing the end therefrom. The line 20 may also provide tamper indication. The line 20 may be any shape or configuration.

As may be appreciated, once the end 14 is removed from the package 10, the interior 22 of the package is opened and in communication with opening 18. Typically during use, less than all of the contents are dispensed at one time. Therefore, it is desirable to effectively close the open end 18 so that the package 10 can retain the remainder of the contents. A reclosable member 24 is provided about open end 18 which reseals the open end in the closed position.

Figure 1:
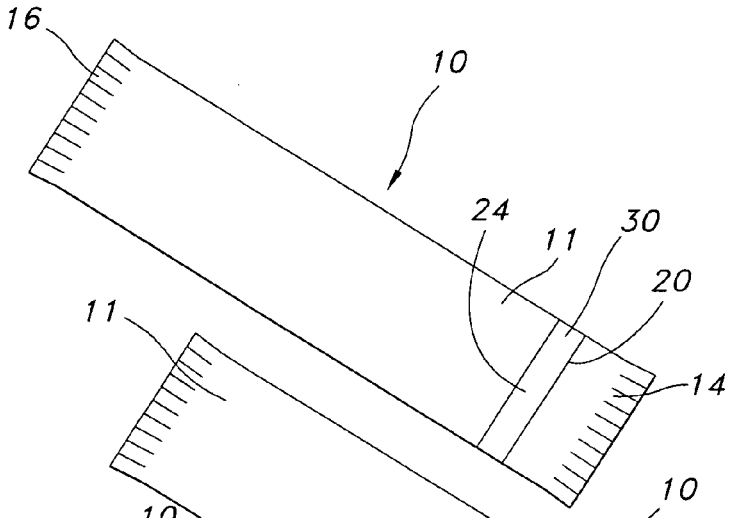
FIG. 1 shows a package of the present invention.
Figure 3:
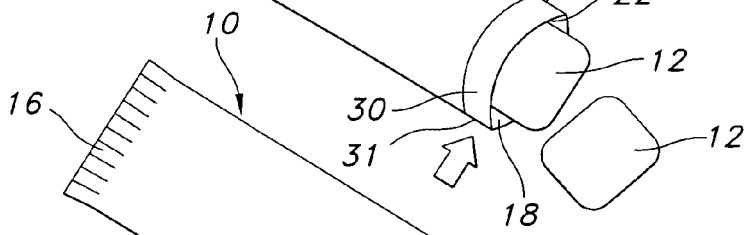
FIG. 3 shows a package of FIG. 1 in an open condition to dispense product.

As shown in the figures, reclosable member 24 may include a resilient band 30 which circumscribes the tubular package body 11 about opening 18. The band 30 may be a continuous member formed of one piece. The band 30 is positioned inwardly adjacent sealed end 14. The resilient band 30 may be formed of a wide variety of materials such as polypropylene and has sufficient spring rigidity to be maintained in a closed condition as shown in FIG. 1, yet it is flexibly openable under manual squeeze pressure as shown in FIG. 3.

Figure 4:
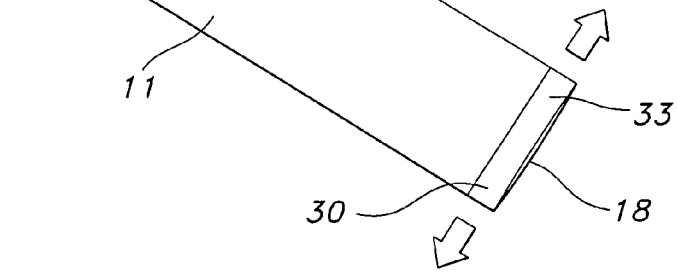
FIG. 4 shows a package of FIG. 1 in a reclosed condition.

Band 30 may be secured to package 10 by a wide variety of techniques including the use of adhesive, heat or ultrasonic welding. The band 30, which may be applied to the inside (FIG. 6A) or outside (FIG. 1) of the package, is positioned inwardly adjacent end 14 a sufficient distance so as to permit easy tearing of the end 14 from the package to dispense the gum pieces 12. Once the end 14 is removed, the band 30 may be opened by manual squeeze pressure. Preferably, the band is opened by a user applying a force to opposed ends 31 of the band as shown in FIG. 3. This forms opening 18 through which one or more of the gum pieces 12 may be dispensed. Once the desired number of gum pieces is dispensed, the manual squeeze pressure on the band 30 may be released and as shown in FIG. 4. The band 30 then returns to its original condition under spring action of the band to such that the opposed sides 33 of the band engage each other closing the opening 18 preventing the remaining gum pieces 12 from exiting the package.

Figure 5:
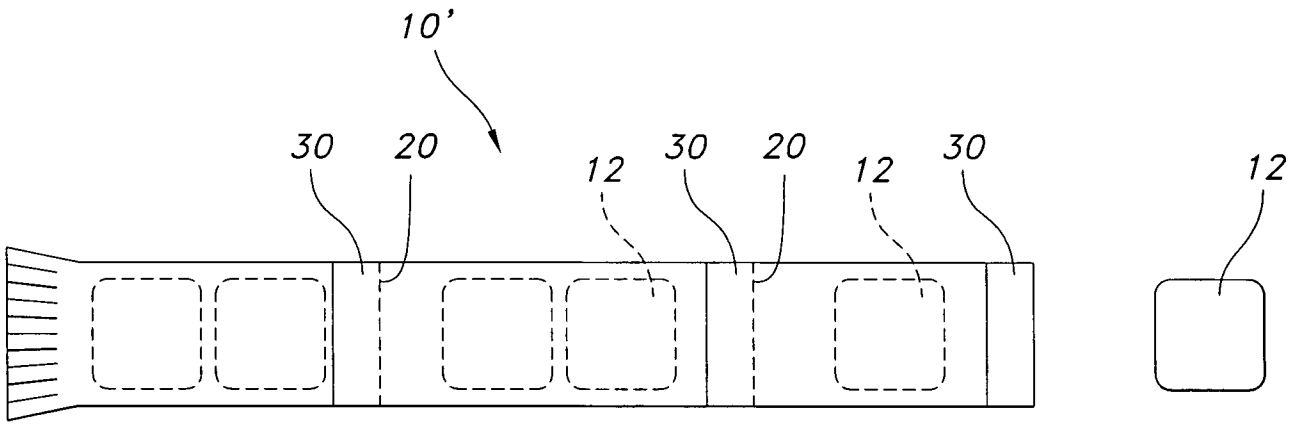
FIG. 5 shows an alternative embodiment of the present invention.

As shown in FIG. 5, it is further contemplated that multiple frangible lines 20 may be provided at spaced locations along the length of the package 10'. This would allow an individual product or groups of products in the package to be separately sealed therealong. At each sealed location, a resilient band 30 may be provided so that when each location is in turn opened the band at that location may provide for the reclosing of the package thereat.

Figure 6A:
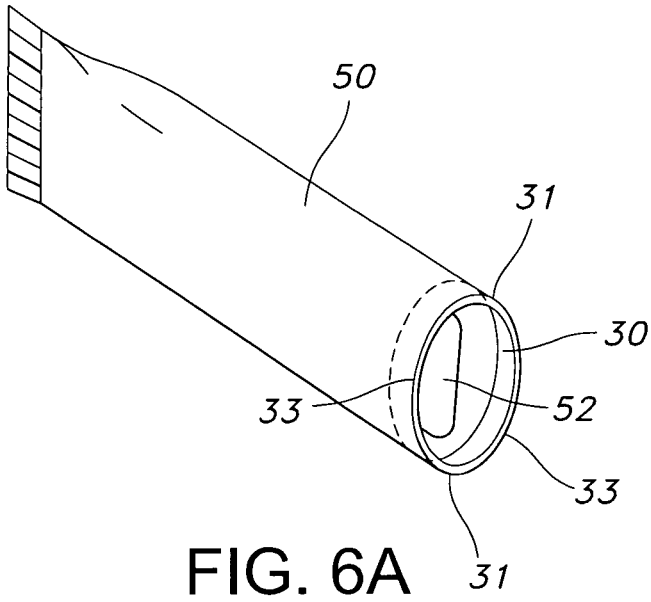
FIG. 6A shows a perspective view of one embodiment of the package of the present invention.
Figure 6B:
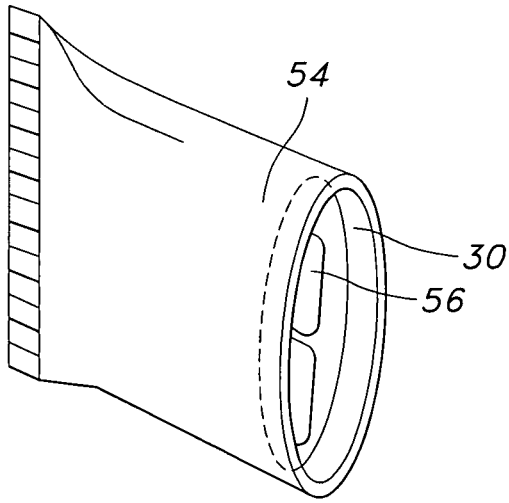
FIG. 6B shows a perspective view of an alternative embodiment of the package of the present invention.

Two arrangements of the present invention are shown in FIGS. 6A and 6B. The first arrangement shown in FIG. 6A includes an elongate tubular package 50 which is designed to hold a plurality of gum pieces 52 in a single longitudinal array. The arrangement of FIG. 6B includes a package 54 is designed to support a plurality of gum pieces 56 in plural rows. Accordingly, it is within the contemplation of the present invention that the package may be formed in a variety of configurations in order to accommodate an arrangement or shape of the contents.

Figure 7:
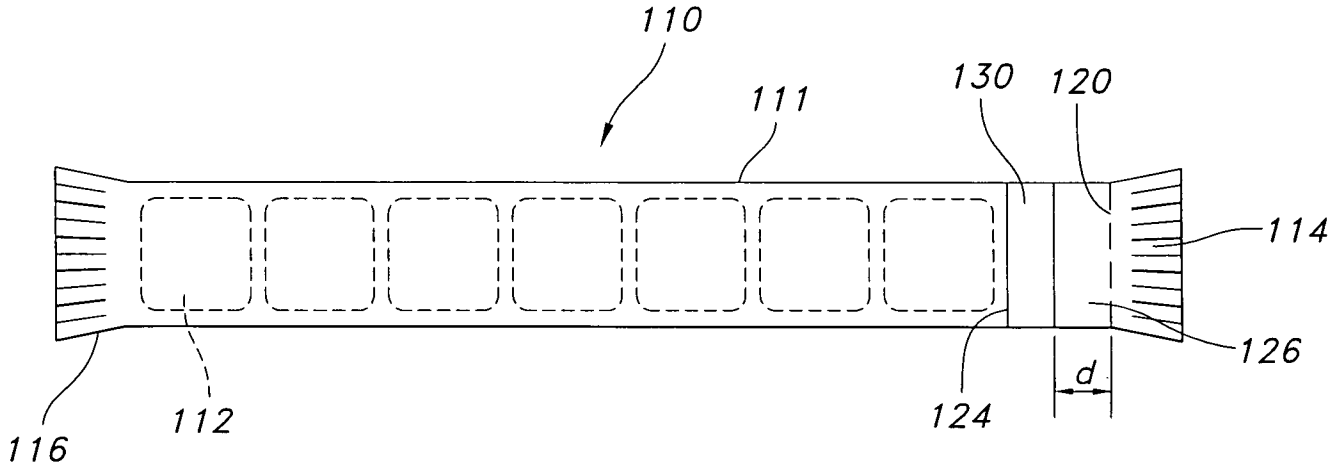
FIG. 7 shows an alternative embodiment of a package of the present invention.
Figure 9:
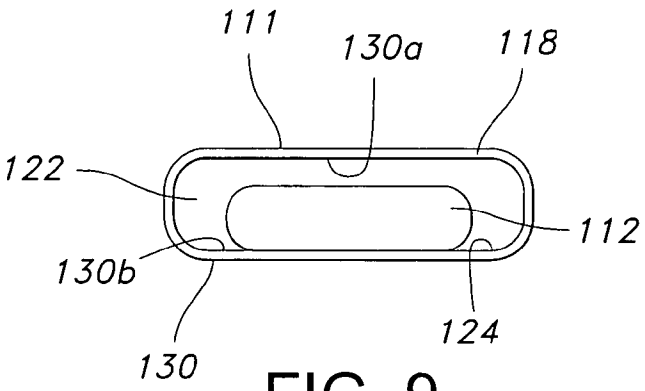
FIG. 9 is a cross-sectional view taken through line 9-9 of FIG. 8.
Figure 8:
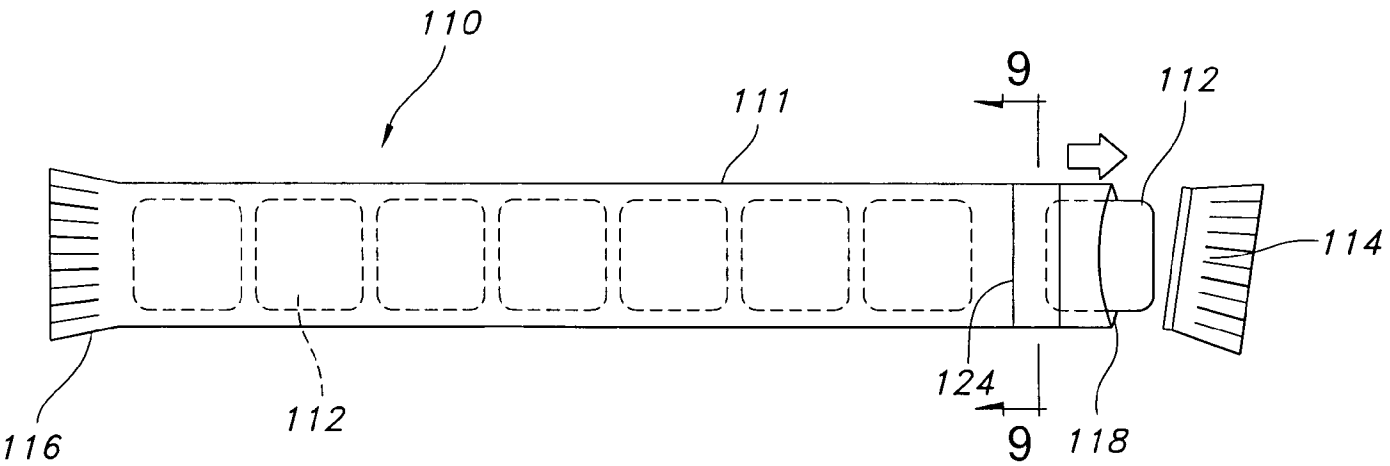
FIG. 8 shows the package of FIG. 7 including one sealed end detached therefrom and the product being dispensed.
Figure 10:
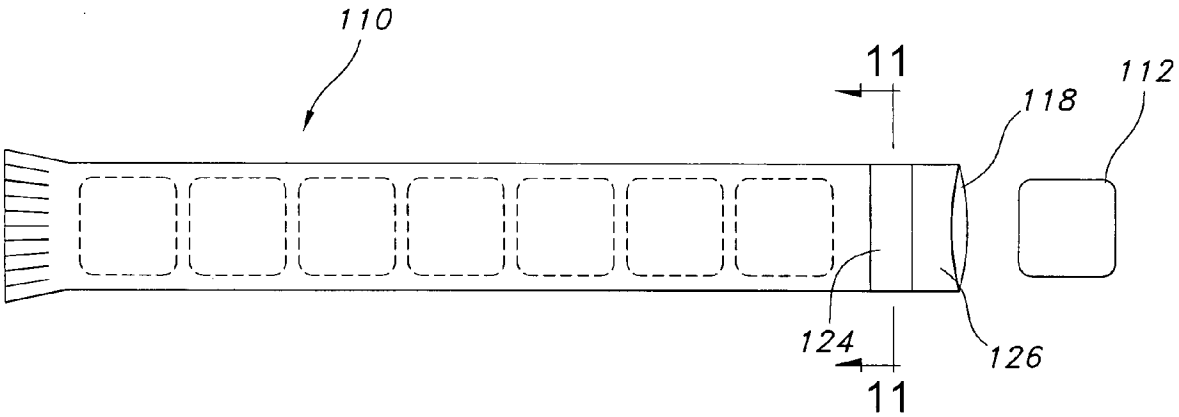
FIG. 10 shows a package of FIG. 7 in a reclosed condition.

A further preferred embodiment is shown in FIGS. 7-13. With specific reference to FIGS. 7-12, package 110 may contain and dispense product pieces 112. Package 110 may be generally formed in a manner similar to package 10 described above having a generally tubular body 111 with ends 114 and 116 which are sealed closed. One of the ends 114 or 116 may be opened to permit dispensing of the product pieces 112 therefrom. In one embodiment, the end may be detached from the package 110 to open it. Alternatively, the end may be opened and not detached from the package. As shown in FIGS. 8 and 10, end 114 may be detached from the body 111 providing an open end 118 through which the product pieces 112 may be dispensed. End 114 may be removed by tearing it from the remainder of the package 110. End 114 may include a frangible line 120 (FIG. 7) therearound which assists in tearing the end 114 from the body 111 of the package 110. The line 120 may be a score line or a laser cut line of any shape or configuration which assists in removing the end therefrom.

As shown in FIGS. 8 and 9, when the end 114 is removed from the package 110, the package interior 122 is open and in communication with opening 118. If the entire product is not dispensed from the package 110, the open end 118 may be reclosed so that the package 110 can retain the remainder of the contents. A reclosable member 124 is provided about opening 118.

Figure 11:
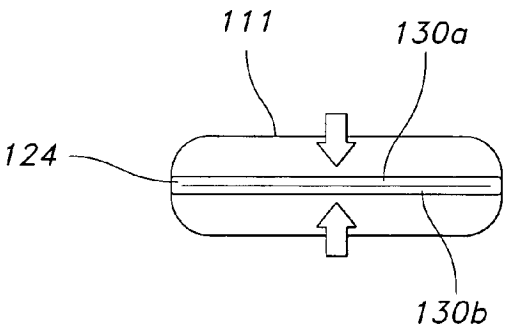
FIG. 11 is a cross-sectional view taken through line 11-11 of FIG. 10.

In this embodiment, reclosable member 124 preferably includes a band 130 of material which circumscribes the body 111 of tubular package 110 about opening 118. The band 130 is positioned inwardly from the sealed end 114 and inwardly from frangible line 120. The band 130 may be formed of an adhesive material that will adhere to itself forming a seal. The seal may be opened and reclosed repeatedly to permit a user to dispense a portion of the contents and then reseal the package. The seal may be a cold seal that permits repeatable sealing. With reference to FIGS. 10 and 11, the seal is effected by the application of moderate pressure by a user such that opposing surfaces of the band, 130*a* and 130*b*, engage each other and adhere, thereby sealing the opening 118.

The band 130 may be formed of an adhesive that bonds when exposed to pressure, such as a pressure sensitive adhesive tape that is applied to the packaging. The adhesive preferably forms a bond that is strong enough to keep the surfaces 130*a* and 130*b* secured together, but also allows the surfaces to be pulled apart and separated without tearing or damaging the package 110. The surfaces 130*a* and 130*b* may then be brought together to reseal the package. Such adhesives may include solid microsphere adhesives and silicone gel adhesives. Alternatively, the adhesive may be formed of a wax such as vegetable or fruit wax. The adhesive may be of a type which has a low tack surface but forms a solid bond with itself, such that when the opposing surfaces are brought together a seal is made. However, since the tackiness of the surface is low, it does not restrict the passage of the product when it is dispensed through the open end 118. When the packaging is used with a comestible, the adhesives would be those which are FDA approved for use with food.

With reference to FIG. 7, the reclosable member 124, which may be applied to the inside of the package, is positioned inwardly from end 114 a sufficient distance so as to permit easy tearing of the end 114 from the package to dispense the gum pieces 112. The reclosable member 124 may be spaced a distance "d" inwardly from the frangible line 120. This leaves a section of packaging which is un-adhered outward of the reclosable member 124, which provides a gripping area 126 for a user to manipulate in order to assist in overcoming the reclosable member and reopen the package. This forms opening 118 through which one or more of the product pieces 112 may be dispensed. Once the desired number of product pieces is dispensed, the opposed surfaces of the packaging close the opening 118, preventing the remaining product pieces 112 from exiting the package. The seal may also protect the product from contamination and moisture.

Figure 12:
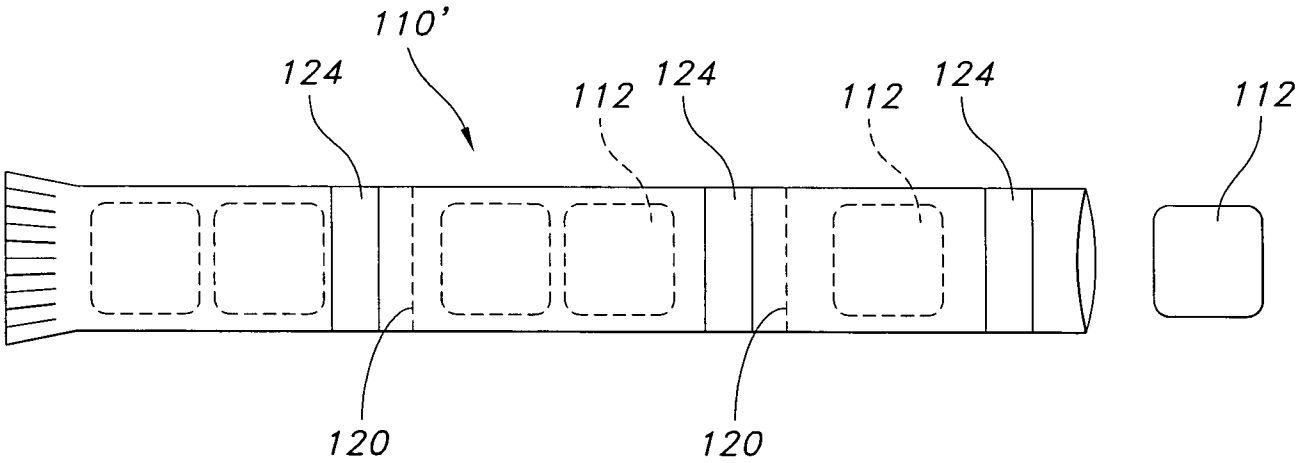
FIG. 12 shows an alternative embodiment of the present invention.

With reference to FIG. 12, it is further contemplated that multiple frangible locations 120 may be provided at spaced locations along the length of the package 110'. This would allow an individual product or groups of products 112 in the package to be separately sealed therealong. At each sealed location, a reclosable member 124 may be provided so that when each location is in turn opened the reclosable member 124 at that location may provide for the resealing of the package thereat.

Figure 13:
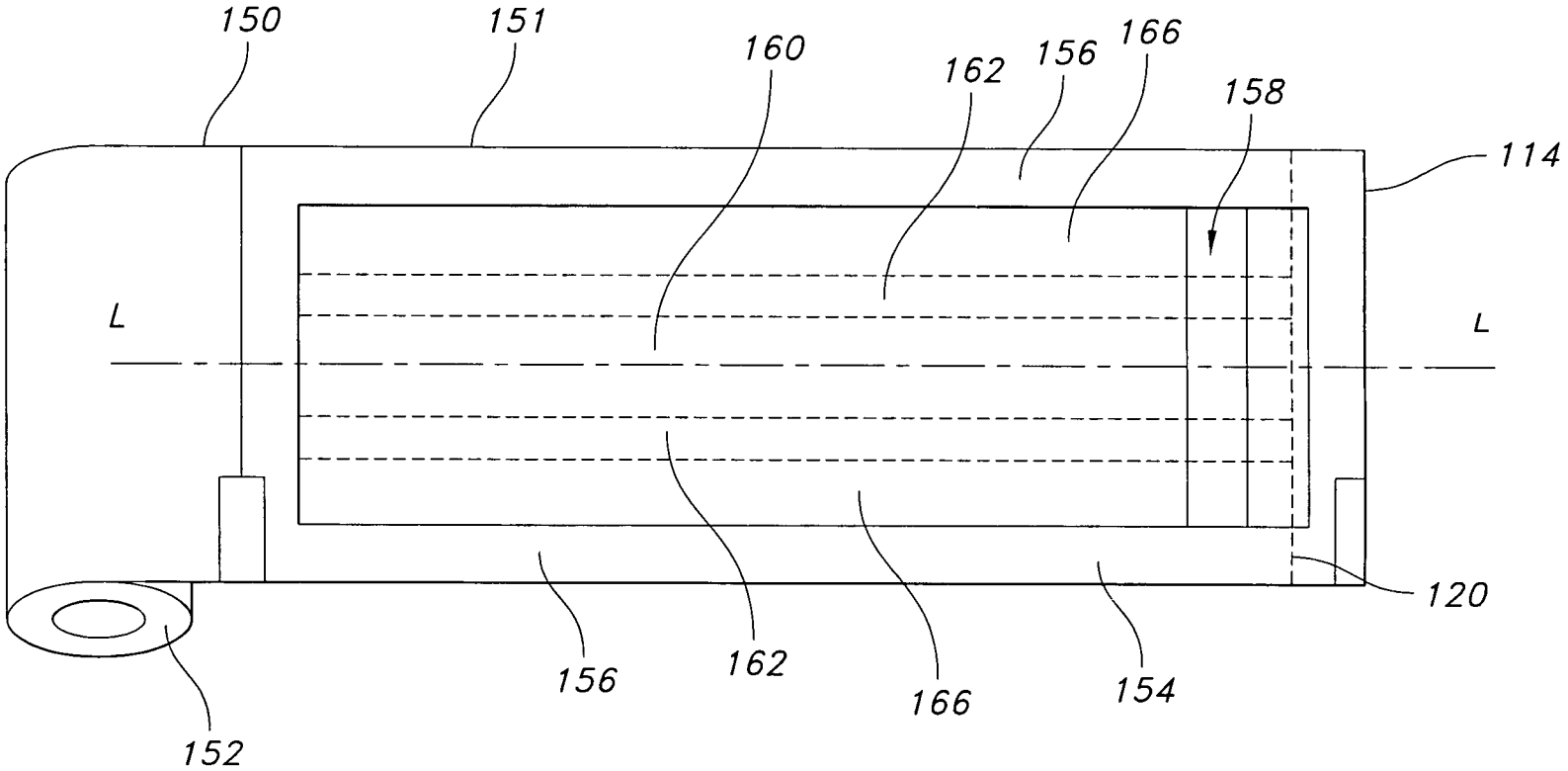
FIG. 13 shows a film for forming the package of FIG. 7.

With reference to FIG. 13, the packaging of the present invention may be formed of a film 150 which is taken off a roll 152. The film 150 may be parted forming a blank 151 and treated at the perimeter 154 with a sealing material 156. Preferably, the film may be pretreated with the perimeter sealing material. The sealing material 156 may be a cold seal or heat seal type, which results in a permanent seal. The blank 151 may also be coated adjacent one end with a resealable material 158, such as a cold seal adhesive, to form the reclosable member 124. The frangible line 120 may be formed between the end 114 and the resealable material 158. A blank central portion 160 may form the front panel of the package. Side panels 162 may longitudinally bound the central portion 160 and form the sides of the package. Adjacent to the side panels 162 are back panels 166 which form the back of the package. The blank 151 may then be folded along its longitudinal axis, L-L, such that the treated perimeter edges meet to form the package 110. One end, 114, may be left unsealed to permit the package to be filled. The package may be filled with the product pieces 112 after which the open end may be permanently sealed. It is within the contemplation of the present invention that the package 110 may be formed in a variety of manners as is known in the art.

Various changes to the foregoing described and shown structures would now be evident to those skilled in the art. Accordingly, the particularly disclosed scope of the invention is set forth in the following claims.

What is claimed is:

1. A package comprising:

a package body having closed ends, at least one of the closed ends being openable by removal of a detachable end portion, the package body being formed of a single wall thin-film flexible material; and a reclosable member including a plurality of discrete bands applied in a spaced manner along a length of the inner surface of the package body, wherein the package is self-closed by the bands at a plurality of locations along the length of the package body forming a plurality of closed product holding spaces a first band of the plurality of bands being adjacent to and encircling the openable closed end, the first band having opposed ends, and wherein a surface of the package body adjacent the opposed ends follows a contour of the first band forming opposed generally smooth and uninterrupted engagement surfaces; and the reclosable member maintaining the openable end in a closed condition after opening thereof and the openable end being selectively and repeatedly openable under manual squeeze pressure applied to the engagement surfaces and reclosable upon release of the manual squeeze pressure, and the plurality of bands being formed of a resilient material, separate from the thin-film flexible material, having spring rigidity to maintain the openable end and the product holding spaces in a closed condition.

2. The package as defined in claim 1, wherein the first resilient band maintains the openable end in a closed condition and being openable under manual squeeze pressure to open the package, and reclosable after release of the manual squeeze pressure.

3. A package of claim 2 wherein each of the resilient bands are formed as one piece.

4. A package of claim 2, wherein the plurality of bands are secured to the package body by means consisting essentially of adhesive and welding.

5. A package of claim 2, wherein each of the plurality of bands are has opposed ends and upon subjecting the opposed ends to a force thereon results in the band assuming an open position to provide access to an inside of the package body.

6. A package of claim 1 wherein the closed ends are heat sealed.

7. A package of claim 1 wherein the closed ends are crimp sealed.

8. A package of claim 1 wherein the detachable end includes a tear line for effecting the detachment thereof.

9. A package of claim 8 wherein the tear line includes a mechanical score line.

10. A package of claim 8 wherein the tear line includes a laser score line.

11. A package of claim 1 wherein the package body includes confectionary products.

12. A package of claim 11 wherein the confectionery products are selected from the group consisting of gum sticks, gum pellets, gum slabs, gum pillows, gum pieces, candy and chocolate.

13. A package of claim 1 wherein the package body has a tubular configuration.

14. A package of claim 1, wherein the plurality of bands are secured to an inner surface of the package body.

15. A package of claim 1, wherein the plurality of bands are secured to an outer surface of the package body.

16. A package of claim 1, wherein the plurality of bands are formed separately from the package body and fixedly secured band thereto.

17. A package of claim 1, wherein the band has a length substantially less than a length of the package body.

18. A package for confectionary products comprising:

a package body having closed ends, at least one of the closed ends being detachably sealed; and a plurality of discrete bands applied in a spaced manner along a length of the package body wherein the package is self-closing by operation of the bands at a plurality of locations along the length of the package body forming a plurality of product holding spaces, the resilient bands having opposed ends; and the resilient bands maintaining the plurality of product holding spaces in a closed condition after detachment of the detachable end and being openable under manual squeeze pressure applied to the ends of the resilient bands to form a package openings, and reclosable after release of the manual squeeze pressure, the package body and bands together forming a smooth continuous surface at the end of the bands.

19. A package of claim 18 wherein the detachable end includes a tear line for effecting the detachment thereof.

20. A package of claim 19 wherein the tear line includes a mechanical frangible line.

21. A package of claim 19 wherein the tear line includes a laser frangible line.

22. A package of claim 18 wherein the each of plurality of resilient bands is a discrete continuous band applied to a surface of the package body.

23. A package of claim 18, wherein the package body is formed of a thin-film flexible material and at least one of the resilient band is formed of a resilient material having spring rigidity to maintain the one detachably sealed closed end in a closed condition.

* * * * *

UNITED STATES PATENT AND TRADEMARK OFFICE

CERTIFICATE OF CORRECTION

PATENT NO. : 8,485,728 B2
APPLICATION NO. : 12/002390
DATED : July 16, 2013
INVENTOR(S) : Paul K. Bowers, James A. Glydon and Allen Aldridge It is certified that error appears in the above-identified patent and that said Letters Patent is hereby corrected as shown below:

IN THE SPECIFICATION:

Column 3, Line 4

Now reads: "of a of a"

Should read: "of a"

Column 3, Line 24

Now reads: "may integrally formed"

Should read: "may be integrally formed"

Column 4, Line 60

Now reads: "The adhesive preferrably"

Should read: "The adhesive preferably"

IN THE CLAIMS:

Claim 5, column 6, Line 32

Now reads: "bands are has"

Should read: "bands have"

Claim 18, Column 7, Line 8

Now reads: "form a package openings"

Should read: "form a package opening"

Claim 23, Column 7, Line 22-23

Now reads: "the resilient band is"

Should read: "the resilient bands is"

Signed and Sealed this
Sixth Day of January, 2015

Michelle K. Lee

Michelle K. Lee
*Deputy Director of the United States Patent and Trademark Office*